US011414973B2

(12) United States Patent
Boyd

(10) Patent No.: US 11,414,973 B2
(45) Date of Patent: Aug. 16, 2022

(54) METHODS AND SYSTEMS ASSOCIATED WITH PRESSURE RELIEF BETWEEN TWO VALVES

(71) Applicant: COMMANDO PRESSURE CONTROL LLC, Kingwood, TX (US)

(72) Inventor: Joseph Mark Boyd, Houston, TX (US)

(73) Assignee: COMMANDO PRESSURE CONTROL INC., Houston, TX (US)

( * ) Notice: Subject to any disclaimer, the term of this patent is extended or adjusted under 35 U.S.C. 154(b) by 0 days.

(21) Appl. No.: 17/180,062

(22) Filed: Feb. 19, 2021

(65) Prior Publication Data

US 2021/0262333 A1 Aug. 26, 2021

Related U.S. Application Data

(60) Provisional application No. 62/978,938, filed on Feb. 20, 2020.

(51) Int. Cl.
*E21B 43/26* (2006.01)
*E21B 33/068* (2006.01)
*E21B 34/02* (2006.01)

(52) U.S. Cl.
CPC ..... *E21B 43/2607* (2020.05); *E21B 33/068* (2013.01); *E21B 34/02* (2013.01); *E21B 43/26* (2013.01)

(58) Field of Classification Search
CPC .... E21B 43/2607; E21B 33/068; E21B 34/02; E21B 43/26
See application file for complete search history.

(56) References Cited

U.S. PATENT DOCUMENTS

2014/0048158 A1* 2/2014 Baca ..... E21B 33/068 137/511
2017/0285668 A1* 10/2017 Moseley ..... G05D 16/2093
2020/0115983 A1* 4/2020 Nanney ..... E21B 34/02

* cited by examiner

*Primary Examiner* — James G Sayre
(74) *Attorney, Agent, or Firm* — Pierson Intellectual Property LLC

(57) ABSTRACT

A dump valve positioned between two valves inline valves, wherein the dump valve is configured to remove fluid and/or pressure acting upon the inline valves.

15 Claims, 5 Drawing Sheets

METHODS AND SYSTEMS ASSOCIATED WITH PRESSURE RELIEF BETWEEN TWO VALVES

BACKGROUND INFORMATION

Field of the Disclosure

Examples of the present disclosure relate to methods and systems associated with a dump valve positioned between two inline valves, wherein the dump valve is configured to remove fluid and/or pressure acting upon the inline valves.

Background

A zipper manifold is a system of frac valves that directs treatment fluid to multiple outlets on different lines. Zipper manifolds provide a quick redirection of fracturing pressure from one well associated with a first line to a second well utilizing a second line, enabling hydraulic fracturing operations to run more efficiently by minimizing downtime.

Zipper manifolds also isolate wells from flow and pressure by opening and closing different valves on different lines. When a stage is completed, the valves on a first line associated with the completed stage may be closed, and valves on a second line associated with the next stage may be opened. Conventionally, zipper manifolds use multiple valves, barriers, etc. that are positioned inline, in series, etc., which utilize pressure differential to seal against pressure and/or flow in the closed position. This creates dual barriers along each line between the hydraulic pumps and the wellbore(s). If one of the multiple inline series on a first line leaks, fails, does not fully seat, etc., the second inline valve operates to ensure there is no communication of pressure and/or flow through the line where valves are closed. This redundancy safeguards that a fracturing operation doesn't begin pressuring up and delivering fluid to a first well associated with the first line, while a second well associated with a second line is being fractured.

In operations, a wireline utilizes separate sets of pump trucks to pump down tools to their desired locations in the wellbore with pressurized fluids. Once the wireline is connected to the wellhead, the wellhead valves are opened to provide wireline tools access into the wellbore. This exposes the wellhead and corresponding equipment to well pressure. The wellhead pressure can be bled to reduce the amount of pressure required to pump tools into the wellbore. However, in operation, the second valve on the zipper manifold that is positioned closer to the wellhead receives pressure coming back from the wellhead. Therefore, to seal the closed second barrier, the energy supplied from the wellhead to close the second valve must be substantial enough to energize the sealing mechanism of the valve barrier associated with the second valve. When in use, the second valve may remain in a neutral state because the energy from the wellhead is not substantial enough to energize the sealing mechanisms of the floating barrier. This may cause leakage across the second valve.

Furthermore, after a fracturing operation, pressure within a system is bled off. Yet, a column of fluid remains in the system. This column of unpressured fluid gets trapped in a chamber between the pair of closed inline valves. If the second valve in the valve pair, positioned closer to the wellhead, is in a neutral, floating, or non-energized position during wireline operations, the column of fluid trapped in the chamber between the pair of valves can quickly build pressure during wireline operations. This is due to once a frac stage beings on a second line, the sealing capabilities on a first line are influenced by the pressure within the chamber between the inline valves. Thus, chamber pressure creates a dynamic where the pressure differential across the first valve cannot change because the chamber pressure remains substantially equal to the well-side pressure.

As such, the column of fluid trapped in a chamber between pairs of inline valves introduces a pressure differential that is difficult to overcome due to the increasing pressure within the chamber. Further, as the upstream pressure on the first valve increases, the downstream pressure within the chamber also increases. Therefore, the upstream pressure and the downstream pressure acting upon the first valve remain linked, maintaining a neutral barrier across the first valve. Floating barriers in the non-energized or neutral positions subject the sealing surfaces of the valves to the elements of unwanted frac fluid. Erosion and corrosions damage the sealing surfaces, which diminishes the barriers ability to operate as desired.

Accordingly, needs exist for system and methods for a pressure control system positioned between pairs of inline valves configured to drain fluid and reduce pressure within a chamber between the inline barriers.

SUMMARY

Embodiments are directed towards a draining system that is configured to remove a column of fluid and any pressure positioned between two inline valves on a first line, which may be desired when a second line is being utilized to complete a fracturing operation. The draining system may be configured to control pressure between the two inline valves on the first line, which may lead to increased reliability and durability of valves associated with zipper manifolds. This may also reduce downtime required for equipment maintenance and failures, leading to higher utilization and profitability.

The draining system may include a first line coupled to a zipper manifold, wherein the zipper manifold may also include a plurality of other lines. Pressure associated with the first line and the other lines may impact each other. Multiple inline valves may be positioned on the first line, wherein a chamber may be positioned between a first valve and a second valve.

The first valve and the second valve may be bi-directional floating valves, wherein the floating valves may be floating barrier type valves. The valves may be configured to create barriers to prevent unwanted flow of fluids and/or pressure across a line, upstream or downstream, coupled with a zipper manifold, wherein the zipper manifold may be positioned between a wellbore and a frac pump. The first valve and the second valve may be configured to seal based on a pressure differential across the corresponding valve to a seal pressure and/or fluid from passing in the barrier in the closed and sealed position. However, in embodiments, the first valve and the second valve may be closed but not form a seal if the pressure differential across the corresponding valve is not sufficient enough. The valves seal against pressure and frack media based on a pressure differential associated with a first pressure acting on a first surface of the first valve or the second valve and a second pressure acting on a second surface of the first valve or the second valve. In embodiments, the valves may close and be sealed when the pressure differential across a corresponding valve is greater than a corresponding pressure threshold. In embodiments, the first valve and the second valves may independently close based on their respective pressure differentials across each of the corresponding valves, which may be different or the same at any given point, or remain in a closed but not sealed, neutral, floating, etc. position where pressure across the valve is equalized.

The chamber may be positioned between the first valve and the second valve and be configured to control a pressure between the first valve and the second valve. The chamber may include a dump valve, pressure transducer, high-pressure hosing, and a bleed off reservoir. In embodiments, a pressure associated with the chamber may impact a downstream pressure on the first valve, and an upstream pressure on the second valve.

The chamber may be a housing, void, compartment, etc. positioned between the inline first valve and second valve. The chamber may be configured to be filled with pressurized fluid if either the first valve and/or the second valve are not completely sealed, such as operating in a neutral state, wherein the neutral state the corresponding valve may be closed but not sealed resulting in a leaky valve. In embodiments, the chamber may always have fluid, however the chamber may not always be filled with pressurized fluid. If there is fluid positioned within the chamber, the fluid positioned within the chamber may apply an upstream pressure against the first valve, and may apply a downstream pressure against the second valve, or both. This may cause situations where it is difficult to create a pressure differential large enough to open, close, or fully seat and seal a corresponding valve if the corresponding valve is in a closed but not seated position.

The dump valve may be a valve positioned within and/or fluidly connected to the chamber. The dump valve may be configured to be opened to bleed residual fluid and/or pressure positioned within the chamber. This may assist in controlling the pressure between the first valve and/or the second valve, and the corresponding pressure differentials across the valves. In embodiments, the dump valve may be configured to be opened until the pressure within the chamber is stable, below a pressure threshold, or completely bled to zero psi. The dump valve may be configured to be manually or automatically opened and closed, and may be locally or remotely opened and closed.

The pressure transducer may be configured to determine a pressure within the chamber. The pressure within the chamber may be utilized to determine if either the first valve or the second valves are in a neutral, open, or closed position. In embodiments, the pressure transducer may measure a pressure within the chamber to determine if the pressure within the chamber is increasing or equalizing to a wireline pressure. If the pressure within the chamber is increasing and/or equalizing with the wireline pressure based on pressure transducers associated with the first valve or the second valve, it may be determined that the first valve and/or the second valve is closed but in the neutral, not sealed, position. When the pressure transducer associated with the dump valve has values that indicate that the pressure within the chamber is increasing towards equalization with pressure outside of the chamber may cause the dump valve to open, reducing the pressure within the chamber. Accordingly, the dump valve may open before the pressure within the chamber has equilized with pressure outside of the chamber, assisting in creating a desirable pressure differential across the second valve, and allowing the first valve and/or second valve to be seated and create a seal.

The high pressure hosing may be configured to transport fluid and/or fluids from the chamber into the bleed off reservoir responsive to the dump valve opening.

The bleed off reservoir may be configured to remotely store fluid transported from the chamber through the high pressure hosing.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
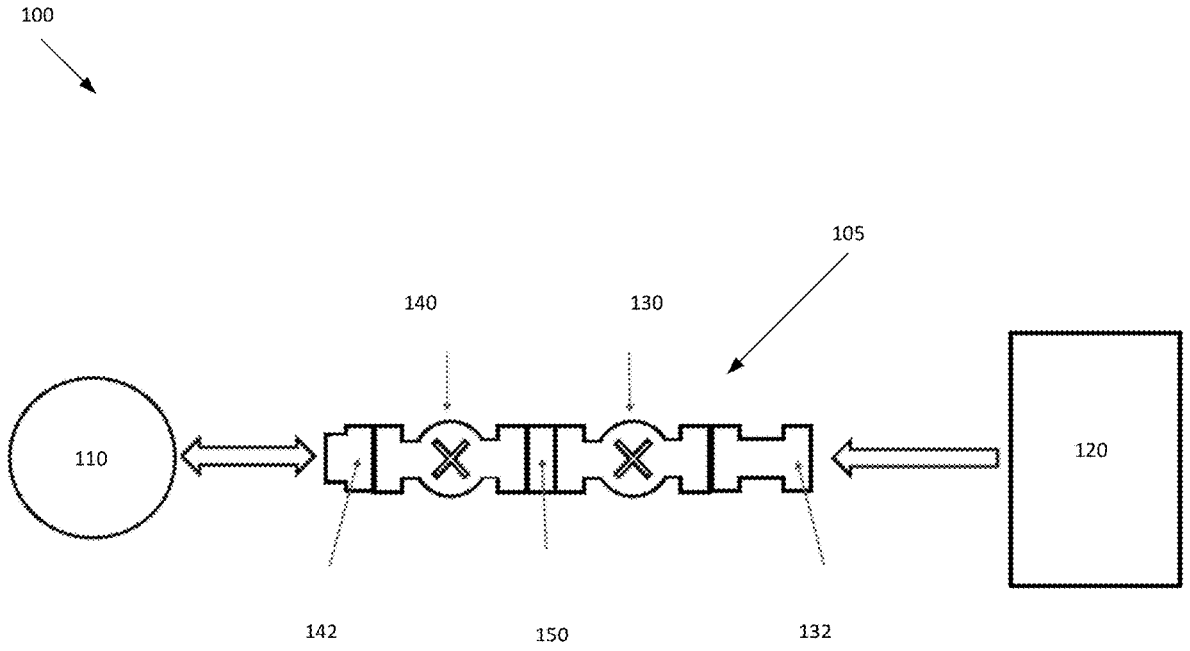
FIG. 1 depicts a manifold system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a manifold system 100, according to an embodiment. Manifold system 100 may be configured to transport fracing fluid from frac pumps 120 to wellhead 110. Manifold system 100 may be comprised of modules that are positioned in series to form an elongated buffer chamber. Coupled to the buffer chamber may be multiple lines 105. Each of the lines 105 may be configured to supply fracing fluid to a corresponding wellhead 110. Furthermore, pressure associated with each of the lines may be dependent on the pressure with other lines. Accordingly, when a fracturing operation is being performed associated with a first line, it may be desirable to fully close and seal other lines. The may allow the line performing the fracturing operation to pressurize quicker and more efficiently without pressure bleeding to other lines. In embodiments, manifold system 100 may be configured to drain a column of fluid and reduce pressure that is positioned between inline valves. By controlling the fluid positioned between multiple valves, manifold system 100 may simultaneously control pressure differentials across multiple valves on the line 105, which may impact pressure differentials across valves on different lines.

Line 105 may include a first valve 130, second valve 140, first pressure transducer 132, second pressure transducer 142, and chamber 150.

First valve 130 and second valve 140 may be bidirectional floating barrier type valves configured to control the passage of fluid through line 105, wherein first valve 130 and second valve 140 are positioned in series and can be open and closed bidirectionally. First valve 130 and second valve 140 may be configured to open and close corresponding barriers to control the pressure and/or fluid flowing through line 105. First valve 130 and second valve 140 may be positioned in series, wherein first valve 130 is positioned closer to an outlet of frac pump 120, and second valve 140 is positioned more proximate to wellhead 110 than first valve 130. Accordingly, when both first valve 130 and second valve 140 are opened, fluid may flow through first valve 130 and second valve 140 to wellhead 110. Further, when fracing operations are completed a column of fluid may remain in line 105 and between wellhead 110 to the frac pump 120, wherein the column of fluid extends across second valve 140 and first valve 130.

First valve 130 and second valve 140 may be floating barrier valves that include barriers that are energized by pressure differential across a corresponding valve to a seal pressure and/or fluid from passing in the barrier while a corresponding valve is in the closed and sealed position. Responsive to a pressure differential across a first side of a valve and a second side of the valve is greater than a closing pressure threshold then the corresponding valve may seal. In embodiments, the first valve 130 and second valve 140 may close and be sealed when the pressure differential across a corresponding valve is greater than a sealing pressure threshold, wherein the sealing pressure threshold may be greater than the closing pressure threshold. However, situations may arise where the pressure differential across first valve 130 and second valve 140 is greater than the closing pressure threshold but not greater than the sealing pressure threshold. This may create a situation wherein the first valve 130 and/or second valve 140 is closed but a seal may not be formed across the valve. This may enable pressure to bleed across the valve, creating a leaky valve. When a valve is leaky, the pressure differential across the valve may create a situation where the valve is in a neutral, floating state, which may allow the pressure across the valve to equalize. If the pressure across the valve is equalized, it may be difficult to create sufficient pressure to seal the valve First pressure transducer 132 may be positioned between first valve 130 and frac pump 120. First pressure transducer 132 may be directly embedded within the flow path and configured to determine a fluid flow data, including fluid pressure, between first valve 130 and frac pump 120. This fluid flow data may assist in determining if first valve 130 and/or second valve 140 are opened, closed or in a neutral state. Specifically, based on the data received from first pressure transducer 132 it may be determined if first valve 130 is opened, closed, or in a neutral state, wherein first valve is closed but not sealed.

Second pressure transducer 142 may be positioned between second valve 140 and well head 110. Second pressure transducer 142 may be directly embedded within the flow path and configured to determine a fluid flow data, including fluid pressure, between second valve 140 and well head 110. This fluid flow data may assist in determining if first valve 130 and/or second valve 140 are opened, closed, or in a neutral state. Specifically, based on the data received from second pressure transducer 142 it may be determined if second valve 140 is opened, closed, or in a neutral state, wherein first valve is closed but not sealed.

Chamber 150 may be a housing, compartment, etc. positioned between first valve 130 and second valve 140. Specifically, chamber 150 may be a volumetric housing configured to be positioned in a fluid flow path between the barriers associated with first valve 130 and second valve 140. As such, responsive to flowing fluid between frac pump 120 and wellhead 110 the fluid flows through first valve 130, chamber 150, and second valve 140.

Figure 2:
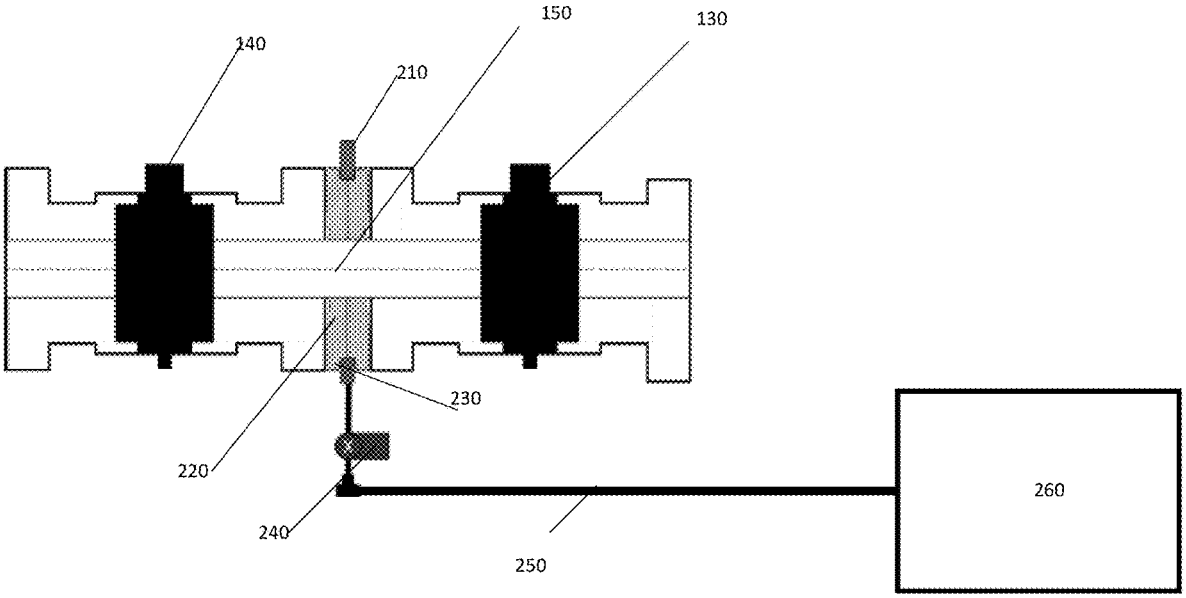
FIG. 2 depicts a chamber positioned between two valves, according to an embodiment.

FIG. 2 depicts chamber 150, according to an embodiment. Chamber 150 may include a chamber pressure transducer 210, flange 220, check valve 230, dump valve 240, high pressure hosing 250, and bleed off reservoir 260.

Chamber pressure transducer 210 may be positioned within chamber 150, and may be directly embedded within the flow path through chamber 150. Chamber pressure transducer 210 may be configured to determine fluid flow data, including fluid pressure, within chamber 150. Based on the data associated with chamber pressure transducer 210, first pressure transducer 132, and second pressure transducer 142, the open, closed, or neutral states of first valve 130 and second valve 140 may be determined.

Flange 220 may be a projecting rim, collar, rib, etc. that is configured to extend from an internal diameter of chamber 150 to an external diameter of chamber 150. Flange 220 may include a passageway that enables fluid to flow from the internal diameter to the external diameter.

Check valve 230 may be a valve that allows fluid to flow from chamber 150 to bleed off reservoir. Check valve 230 may enable the flow of fluid in a single direction, wherein fluid may flow from chamber 150 towards bleed off reservoir 260. Accordingly, check valve 230 may be configured to restrict the ability of fluid flow into chamber 150.

Dump valve 240 may be a valve in series with check valve 230 positioned between check valve 230 and bleed off reservoir 260. Fluid may flow from chamber 150 through dump valve 240 and check valve 230 to bleed off reservoir 260. Dump valve 240 may be configured to be manually or remotely opened or closed to bleed the fluids and pressure from chamber 150. In embodiments, dump valve 240 may be configured to be opened responsive to the first valve 130 and second valve 140 being in the closed position, which may occur prior to wireline and/or fracing operations. This may minimize the fluid and pressure within chamber 150 capacity to pressurize the valves and influence the valves' ability to seal or float in the closed position. Dump valve 240 may be configured to be maintained in the open position until indicators associated with the valves indicate that the valves have moved from a neutral position, where a corresponding valve is closed but not sealed, to a closed and seated or sealed position. This indicator may be associated with chamber pressure transducer 210 indicates that pressure within chamber 150 is stable, decreasing, or bled down to 0 psi. At that point dump valve 240 may be closed, automatically or manually. In embodiments, dump valve 240 may be configured to automatically open responsive to first valve 130 and second valve 140 being in a closed position but not sealed position. This may enable residual fluids trapped in the chamber 150 to be drained. Specifically, dump valve 240 may be configured to be opened when chamber pressure transduce 210 and first pressure transducer 132 determine that the pressure upstream and downstream across the first valve 130 is substantially equal and when chamber pressure transduce 210 and second pressure transducer 142 determine the pressure upstream and downstream across the second valve 140 is substantially equal. As such, dump valve 240 may be opened when pressure readings by chamber pressure transducers 210, first pressure transducer 132, and/or second pressure transducer 142 are moving towards equalization. Accordingly, dump valve 240 may be opened based on readings by any pair of pressure transducers increasing towards equalization before there is actual pressure equalization across the valves.

High pressure hosing 250 may be tubing, hosing, pipes, etc. that is configured to communicate fluid from chamber 150 to bleed of reservoir 260. High pressure hosing 250 may have a proximal end that is coupled to chamber 150, and a distal end that is coupled to bleed off reservoir 260.

Bleed off reservoir 260 may be an atmospheric tank, line, chamber, etc. that is configured to receive fluids from high pressure hosing 250. Bleed off reservoir 260 may be configured to have an atmospheric PSI.

Figure 3:
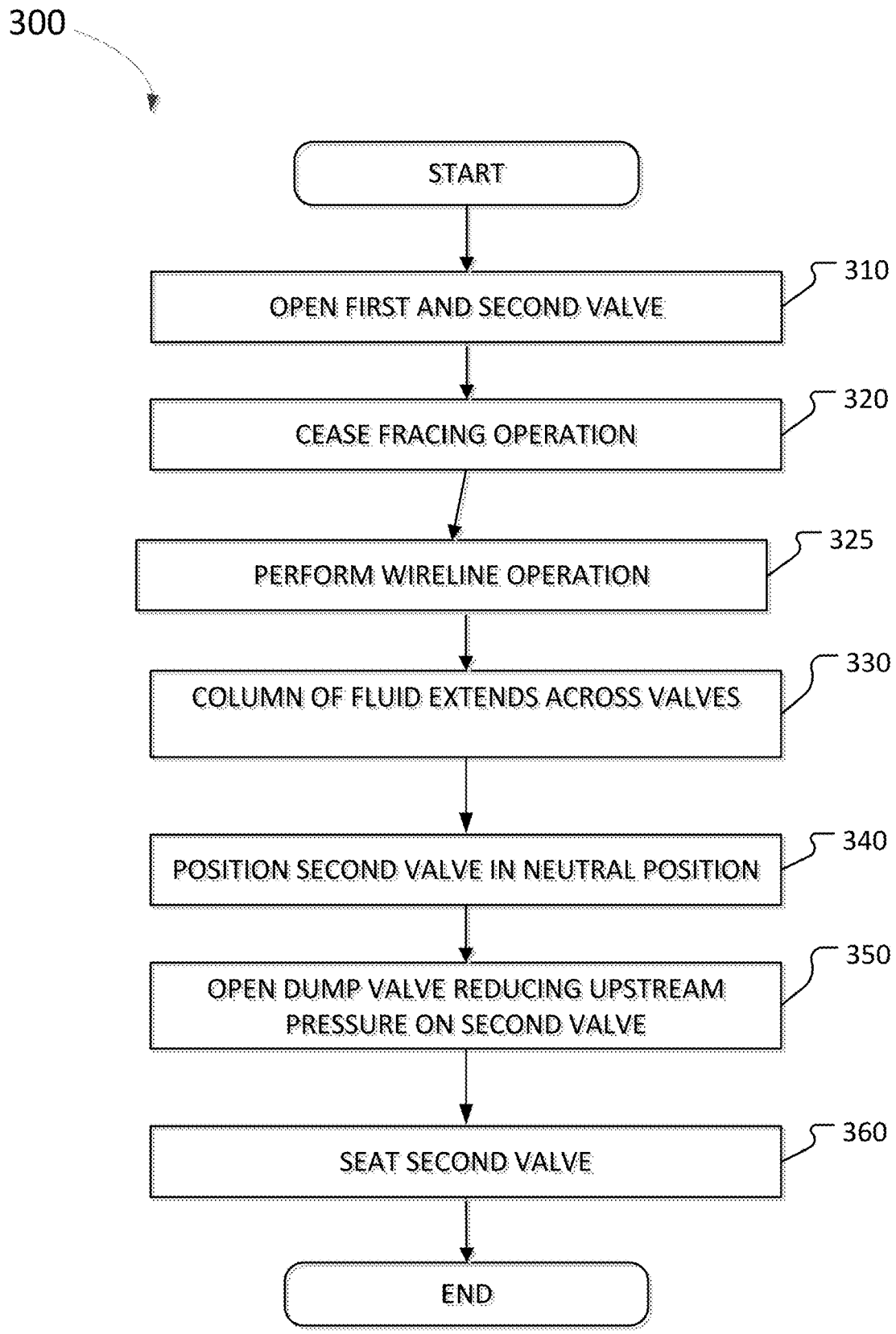
FIG. 3 depicts a method for utilizing a bleed off chamber situated between valves positioned in series, according to an embodiment.

FIG. 3 depicts a method 300 for utilizing a bleed off chamber situated between valves positioned in series, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for multiple lines for a zipper manifold.

At operation 310, a first valve and a second valve associated with a zipper manifold may be opened, and a fracing operation may occur, wherein the second valve is positioned downstream from the first valve.

At operation 320, the fracing operation may cease, wellhead valves are closed, frac pressure from the stage trapped between the wellhead valves are bled off, and zipper valves are closed At operation 325, a wireline may open the wellhead valves to provide entry into the wellbore.

At operation 330, a column of fluid may remain in the line after the fracing operation has ceased. The column of fluid may extend across the closed first valve, closed second valve, and a chamber positioned between the first valve and the second valve, wherein the chamber is positioned upstream from the second valve. The column of fluid may exert forces against first surfaces and second surfaces of the valves, which may restrict creating a pressure differential to fully seal the closed barriers associated with the valves. For example, due to the column of fluid within the chamber exerting a first force on a first surface of the second valve, and the column of fluid between the second surface of the second valve and the wellhead exerting a second force on the second surface of the second valve due to a leaky valve, the second valve may remain in a neutral position. In embodiments, the first surfaces of the valves may be positioned a downhole direction, and the second surfaces of the valves may face an uphole direction.

At operation 340, the second valve may be closed but may not be completely seated or sealed. As such, a complete seal may not be formed across the second valve.

At operation 350, a dump valve associated with the chamber may be opened, allowing the fluid and/or pressure within the chamber between the first valve and the second valve to flow to a dump reservoir. This may reduce the pressure within the chamber exerting the first force on the first surface of the second valve.

At operation 360, responsive to decreasing the pressure acting upon the first surface of the second valve, a pressure differential between the second force on the second surface of the second valve and the first force on the first surface of the second valve may be large enough to fully seat and seal the second valve.

Figure 4:
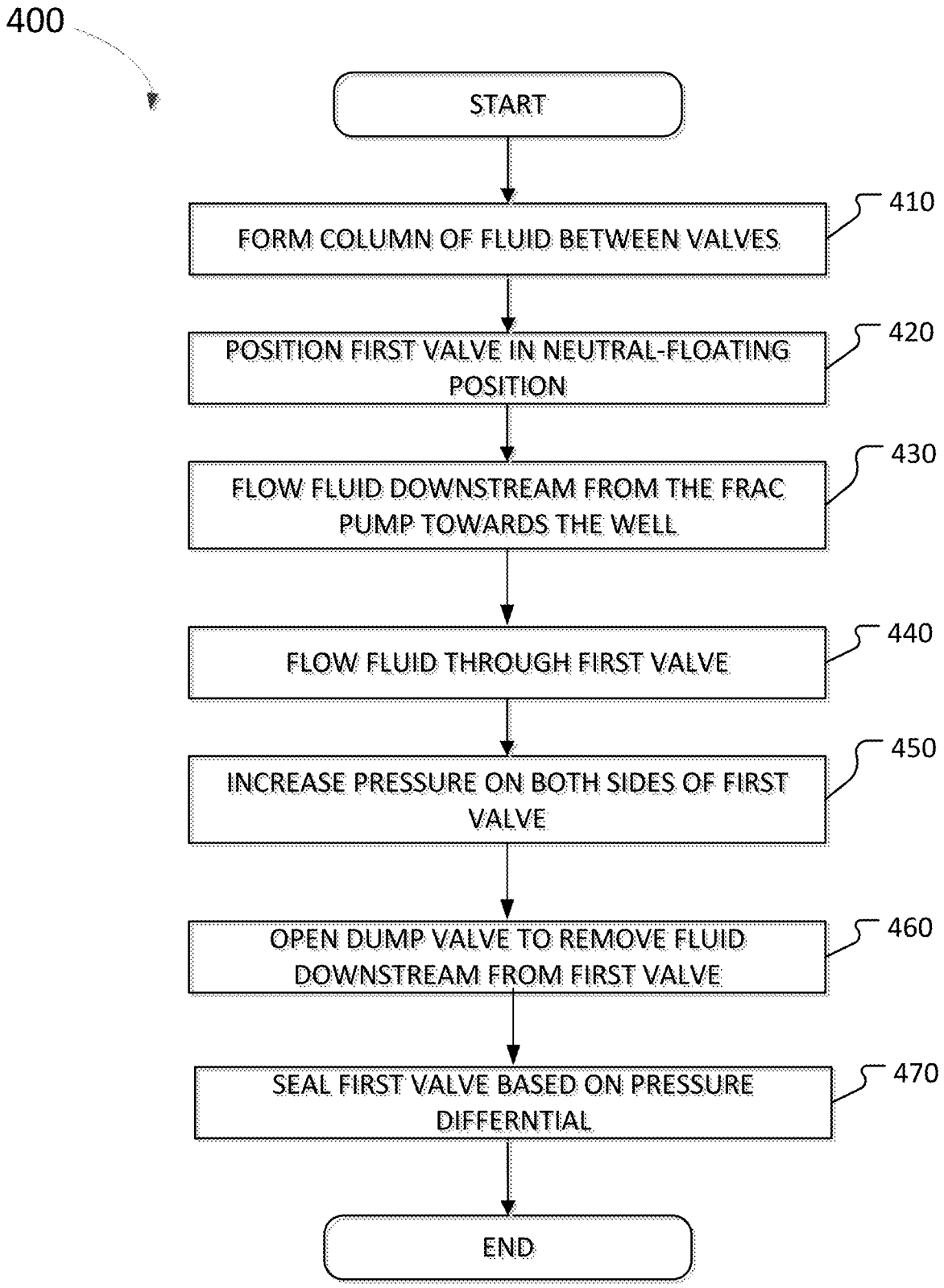
FIG. 4 depicts a method for utilizing a bleed off chamber situated between valves positioned in series, according to an embodiment.

FIG. 4 depicts a method 400 for utilizing a bleed off chamber situated between valves positioned in series, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting. Furthermore, the operations of method 400 may be repeated for multiple lines for a zipper manifold.

At operation 410, a column of fluid may be formed in a chamber positioned between a first valve and a second valve on a first line, wherein the first valve is opened. The first valve being positioned further upstream than the second valve.

At operation 420, the first valve may be closed but in a neutral position that does not form a complete seal.

At operation 430, fluid flowing from a frac pump may create a first force acting upon first surface of the first valve. The force may be created by flowing fluid from the frac pump towards the well. This may occur when other lines are being utilized for a fracturing operation.

At operation 440, due to a complete seal not being formed across the first valve, fluid flowing from the frac pump may pass the first valve. This may cause a second force acting upon a second surface of the first valve, wherein the second force is created by fluid being positioned within the chamber.

At operation 450, responsive to increasing a pressure associated with the first force, a pressure associated with the second force may simultaneously and correspondingly increase. This may limit the availability of creating a pressure differential to completely close and form a seal across the first valve.

At operation 460, a dump valve associated with the chamber, positioned downstream from the first valve, may be opened. This may allow the fluid and/or pressure within the chamber downstream from the first valve to flow to a dump reservoir. This may reduce the pressure within the chamber exerting the second force on the second surface of the first valve.

At operation 470, responsive to decreasing the pressure acting upon the second surface of the first valve, a pressure differential across the first valve may be large enough to fully seat and seal the first valve.

Figure 5:
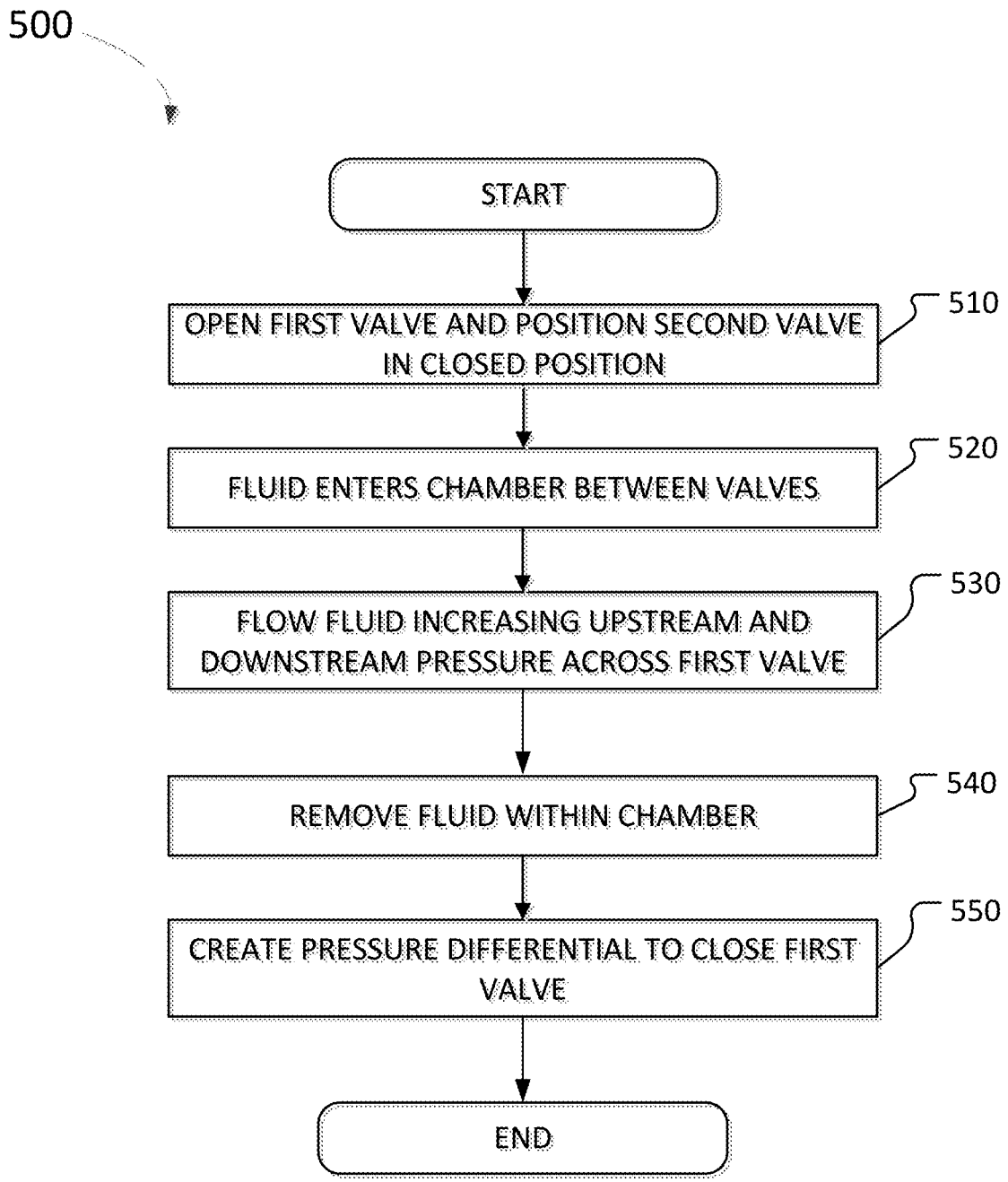
FIG. 5 depicts a method for utilizing a bleed off chamber situated between valves positioned in series, according to an embodiment.

FIG. 5 depicts a method 500 for utilizing a bleed off chamber situated between valves positioned in series, according to an embodiment. The operations of method 500 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting. Furthermore, the operations of method 400 may be repeated for multiple lines for a zipper manifold.

At operation 510, a first valve in a line may be closed and a second valve in a line may be in a closed position but not fully seated, wherein the second valve is positioned downstream from the first valve. When the second valve is in the closed but not fully seated position, leakage may occur across a barrier associated with the second valve.

At operation 520, due to the second valve not being fully seated, pressure, fluids, and/or other containments may pass the barrier associated with the second valve and be positioned within a chamber situated between the first and second valve.

At operation 530, a frac operation may begin through other lines coupled to the zipper manifold where pressure within a manifold system upstream from the first valve is increased, and it is desirable that the first valve and the second valve are closed and sealed.

At operation 540, a dump valve within the chamber may be open to remove the pressure within the chamber. The pressure within the chamber may be reduced even if the first valve is not fully seated, and fluid is traversing a barrier with the first valve during the frac operation. As such, fluid and pressure may be removed from the chamber while fluid is flowing across the first valve.

At operation 550, responsive to removing the downstream pressure by removing the pressure within the chamber acting upon the first valve, a pressure differential across the first valve may be large enough to seat the first valve to close and seal the first valve. Further, by removing the pressure upstream from the second valve, a pressure differential across the second valve may be sufficient to close and seal the second valve.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A pressure relief system for oil and gas operations comprising:

a first valve on a first line;

a second valve on the first line;

a chamber positioned between the first valve and the second valve;

a dump valve positioned within the chamber being configured to be opened to reduce a first pressure within the chamber, the pressure within the chamber impacts the first valve and the second valve, wherein the first valve and the second valve are configured to close responsive to the dump valve opening to reduce the first pressure within the chamber, wherein the first pressure within the chamber directly impacts an upstream surface of the first valve and a downstream surface of the second valve.

2. The pressure relief system of claim 1, wherein the dump valve is configured to open responsive to the first pressure moving towards equalizing with a second pressure between the first valve and a frac pump.

3. The pressure relief system of claim 2, wherein the first valve is configured to close and form a seal based on a first pressure differential across the first valve being higher than a first sealing pressure threshold after the dump valve is opened.

4. The pressure relief system of claim 1, wherein the dump valve is configured to open responsive to the first pressure moving towards equalizing with a third pressure between the second valve and a wellhead.

5. The pressure relief system of claim 4, wherein the second valve is configured to close and form a seal based on a second pressure differential across the second valve being higher than a second sealing threshold after the dump valve is opened.

6. The pressure relief system of claim 5, wherein the dump valve is configured to close responsive to closing and sealing the second valve, wherein the second valve is configured to be closed but not form the seal based on pressure being applied from a static column of fluid from the wellhead to both surfaces of the second valve.

7. A pressure relief system for oil and gas operations comprising:

a chamber with a dump valve;

a first valve on a first line, the first valve having a first surface facing a well and a second surface facing the chamber, the first valve being configured to close based on a pressure differential across the valve being greater than a closing pressure threshold, and the first valve being configured to close and form a seal based on the pressure differential across the valve being greater than a sealing pressure threshold, the sealing pressure threshold being greater than the closing pressure threshold, the dump valve being configured to remove pressure within the chamber to increase the pressure differential from an amount greater than the closing pressure threshold but lower than the sealing pressure threshold to an amount greater than sealing pressure threshold.

8. The pressure relief system of claim 7, wherein a first pressure is applied to the first surface of the first valve and a second pressure is applied to the second surface of the first valve is created by a column of fluid remaining in the first line after a fracturing operation has ceased.

9. The pressure relief system of claim 8, wherein the column of fluid creates a pressure differential across the first valve that is greater than the closing pressure threshold but smaller than the sealing pressure threshold.

10. The pressure relief system of claim 9, wherein the dump valve is configured to open to reduce the second pressure being applied to the second surface of the first valve.

11. The pressure relief system of claim 10, wherein when the dump valve reduces the second pressure the pressure differential becomes greater than the sealing pressure threshold.

12. The pressure relief system of claim 11, wherein the dump valve is configured to automatically close after the pressure differential become greater than sealing pressure threshold.

13. A pressure relief system for oil and gas operations comprising:

a chamber with a dump valve;

a first valve on a first line, the first valve having a first surface facing the chamber and a second surface facing a frac pump, the first valve being configured to close based on a pressure differential across the valve being greater than a closing pressure threshold, and the first valve being configured to close and form a seal based on the pressure differential across the valve being greater than a sealing pressure threshold, the sealing pressure threshold being greater than the closing pressure threshold, the dump valve being configured to remove pressure within the chamber to increase the pressure differential from an amount greater than the closing pressure threshold but lower than the sealing pressure threshold to an amount greater than sealing pressure threshold.

14. The pressure relief system of claim 13, wherein a first pressure is applied to the second surface of the first valve based on fluid flowing from the frac pump to a second line, and a second pressure is applied to the second surface of the first valve is fluid leaking into the chamber across the first valve.

15. The pressure relief system of claim 14, wherein the first pressure and the second pressure create a pressure differential across the first valve that is greater than the closing pressure threshold but smaller than the sealing pressure threshold.

* * * * *